United States Patent [19]

Morrison

[11] 4,261,694

[45] Apr. 14, 1981

[54] AIR VIBRATED/WINCHED CONCRETE SCREED

[76] Inventor: Donald R. Morrison, 2109 Camp Green St., Charlotte, N.C. 28208

[21] Appl. No.: 132,623

[22] Filed: Mar. 21, 1980

[51] Int. Cl.[3] ..... B28B 17/00; B28B 1/08

[52] U.S. Cl. ..... 425/456; 404/119

[58] Field of Search ..... 264/218, 456; 404/96, 404/98, 101, 106, 114, 118, 119, 120, 133

[56] References Cited

U.S. PATENT DOCUMENTS

| | | | |
|---|---|---|---|
| 1,390,479 | 9/1921 | Baker | 404/96 |
| 2,592,960 | 4/1952 | Schulze | 404/119 |
| 3,377,933 | 4/1968 | Dale | 404/106 |
| 3,412,658 | 11/1968 | Griffin | 404/119 |
| 3,453,988 | 7/1969 | Trent et al. | 404/119 |
| 3,767,312 | 10/1973 | Raymond et al. | 404/106 |
| 4,030,873 | 6/1977 | Morrison | 425/456 |
| 4,132,492 | 1/1979 | Jenkins | 404/119 |

FOREIGN PATENT DOCUMENTS

| | | | |
|---|---|---|---|
| 510260 | 2/1955 | Canada | 404/119 |

*Primary Examiner*—W. E. Hoag
*Attorney, Agent, or Firm*—B. B. Olive

[57] ABSTRACT

A vibrating concrete screed utilizes a plurality of air-driven vibrators which are mounted on an elongated frame in a manner designed to achieve a unique vibration pattern throughout the length of the frame. An air-driven winch on the screed enables the screed to be winched automatically and at a controlled speed while the screed is being vibrated.

11 Claims, 6 Drawing Figures

AIR VIBRATED/WINCHED CONCRETE SCREED

CROSS-REFERENCE TO RELATED APPLICATIONS

This application is related to the subject matter of applicant's prior U.S. Pat. No. 4,030,873 and copending applications Ser. No. 883,955 filed Mar. 6, 1978, entitled "PORTABLE VIBRATING CONCRETE SCREED" now U.S. Pat. No. 4,213,749 and Ser. No. 29,654 filed Apr. 13, 1979, entitled "WINCHING APPARATUS FOR VIBRATING CONCRETE SCREED".

BACKGROUND OF THE INVENTION

1. Field of the Invention

This invention relates to lightweight, portable, vibrating concrete screeds and more specifically to air-operated vibrating screeds.

2. Description of the Prior Art

Lightweight, portable, vibrating, concrete screeds of the type to which the present invention is generally related are described in applicant's prior U.S. Pat. No. 4,030,873 and the referred to copending applications Ser. Nos. 883,955 and 29,654. The general state of the art is believed to be fully set forth in these references and therefore will not be restated except for pointing out certain prior art practices which specifically relate to the subject matter of the present invention.

In particular, since the present invention is directed to an air-powered concrete screed, it should be noted that air vibrators have been secured to both leading and trailing screed blades in a staggered relationship as a means of vibrating the elongated screed frame. However, this arrangement means that each point of vibration requires its own air vibrator. Also, this arrangement does not allow the vibrations from each air vibrator to be imparted to both leading and trailing blades. Thus, it would be desirable to provide an air-vibrated concrete screed in which a lesser number of air vibrators were required to achieve the vibration. Also, it would be desirable to provide an arrangement by which each vibrator could establish points of vibration offset from each other lengthwise of the screed frame.

As another aspect of the type of construction used in portable vibrating concrete screeds of the type to which the invention relates, it may be noted that the typical screed frame is made up of components which are welded together. Due to the stringent operating requirements and heavy wear encountered on the job, it is not uncommon for a frame member to be bent or damaged and thus require replacement. An all-welded construction, of course, makes replacement of an individual frame component both time consuming and expensive. Since the typical portable, concrete screed of the type to which the invention relates has a triangular cross section, it has become the practice to use a piece of ordinary steel pipe running lengthwise of the frame at the apex of the triangle and the frame braces are welded to this pipe. This pipe has also been used as a conduit for carrying pressurized air and air vibrator hoses have been connected to the pipe as a means for supplying air to the vibrators. While the use of a pipe member of this type as both a structural member and as an air conduit is advantageous, a simple round pipe of this kind does not lend itself readily to the type of screed frame in which the members are bolted together for ease of replacement when damaged. Thus, there is a need for an improved screed frame adapted to be bolted together and employing an improved apex tube construction that both lends itself to serving as an air conduit as well as a structural member which can be easily bolted to other structural members for establishing a relatively rigid screed frame.

As a further aspect of screed constructions, it has been known to provide means enabling one screed section to be angled relative to another screed section to adjust to concrete pouring operations where a crown or valley shape is formed with the screed. Thus, with air-operated screeds, it would be desirable to provide an air-operated screed frame construction in which a tubular member located at the apex of the triangular-shaped frame and serving as an air conduit could also be used as a means for adjusting one screed section relative to another. However, such an arrangement has not been previously known in prior art screed frame constructions.

The use of winching mechanism on portable vibrating concrete screeds of the type to which the invention relates has been well established. However, so far as applicant is aware, it has not been heretofore known to provide an air-operated winch in conjunction with an air-operated screed and arranged such that air can be supplied both to the winch mechanism as well as to the air vibrators through a common structural member.

The object of the invention thus becomes that of providing an improved air screed aimed at overcoming the shortcomings of prior screed constructions as discussed above. Other objects will become apparent as the description proceeds.

SUMMARY OF THE INVENTION

The invention provides an improved, portable, lightweight, vibrating, concrete screed having an elongated frame of triangular cross section with a plurality of air-operated vibrators mounted on strategically positioned brace members so as to achieve a substantially even vibration pattern along the entire screed length. The screed frame is adapted to be bolted together to facilitate replacement of damaged parts. Air is supplied to each vibrator from a compressed air source through a tubular structural member which runs lengthwise of the frame at the apex and mounts appropriate air lines branching off to the vibrators. Through special fittings connected to this tubular structural member, provision is made for adjusting the angle of one screed section relative to the other to accommodate to crown and valley screeding requirements. An air-powered winching apparatus is also mounted on the screed and powered by air supplied through the mentioned tubular structural member such that the screed can be vibrated and winched automatically from a common pressurized air source.

DESCRIPTION OF THE PREFERRED EMBODIMENT

Figure 1:
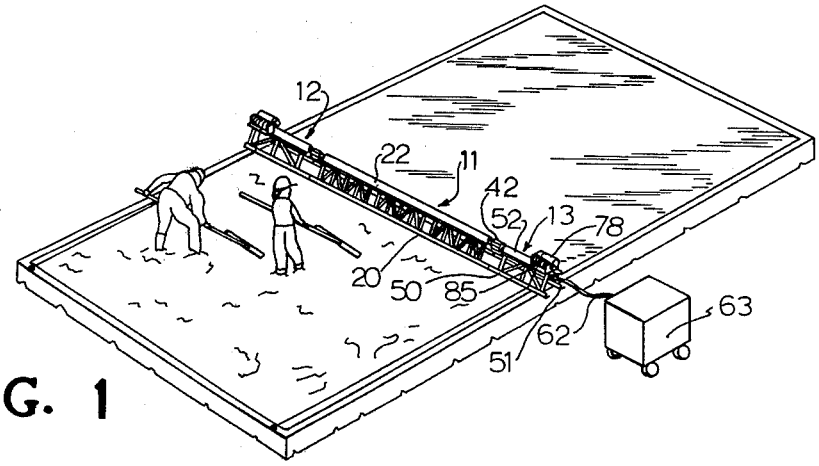
FIG. 1 is an isometric view of an air-powered virbrating concrete screed utilizing air-driven vibrators and air-operated winching frame units at each end according to the invention and shown in use in a typical concrete pouring and finishing operation.

As illustrated in FIG. 1, a screed 10 is illustrated as being formed of a base frame unit 11 and a pair of detachable frame units 12 and 13. In a preferred form, the base frame unit 11 as well as the winching frame units 12 and 13 are made up of components adapted to be bolted together and are illustrated as such. Base frame unit 11 and winching frame units 12, 13 can be of various lengths according to job requirements and can be easily and quickly connected together as later described so as to provide different lengths of screeds for spanning forms of different widths. The base frame unit 11, by way of example, is assumed to be illustrated as being ten feet in length and the winching frame units 12, 13 are each assumed to be illustrated, by way of example, as being two and one-half feet in length.

Referring first to a typical base frame unit 11, base unit 11 is preferably in the form of an isosceles triangle with screed plates 20, 21 forming the lower corners of the triangle and with a specially-designed extruded, hollow ridge tube 22 forming the apex of the triangle. Ridge tube 22 extends throughout the length of base frame unit 11 and is connected to the screed plates 20, 21 by suitable cross braces 23 and vertical braces 24. The hollow structural ridge tube 22 includes a tube portion **22*a* having a bore 26 extending the length thereof and also includes appended, outwardly and downwardly extending flanges 22*b*, 22*c*. Flanges 22*b*, 22*c* are provided with holes 27 and are designed to overlap the upper ends of braces 23, 24 to receive nut and bolt arrangements 28. Braces 23, 24 are also connected to plates 20, 21 by other nut and bolt arrangements 25** as illustrated in the drawings. As previously mentioned, nut and bolt connections are preferred for ease of replacement of brace members in the event of breakage or damage though it will be understood that welded connections could be employed without departing from the scope of the invention.

Figure 5:
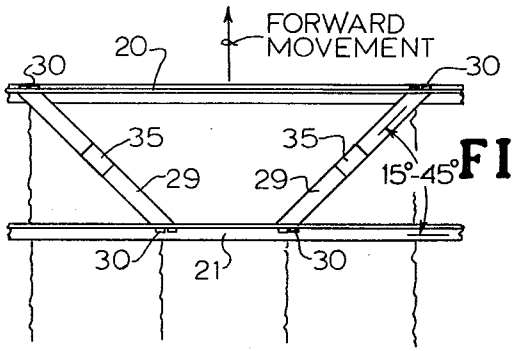
FIG. 5 is a schematic plan view illustrating the vibration pattern established by the screed of FIGS. 1–4.

An important feature of the invention structure relates to the manner in which the air vibrators are mounted in order to achieve a substantially uniform vibration pattern on the work surface. For this purpose, angularly disposed transverse braces 29 extend between leading screed plate 20 and trailing screed plate 21 and are bolted thereto by nut and bolt arrangements 30. Braces 29 are preferably disposed at an angle of approximately 45° relative to the longitudinal axis of screed plate 21 as indicated in FIG. 5 although a range of from 15° to 45°, e.g., is considered to be within desirable limits. Each transverse brace 29 mounts an air-powered vibrator 35 thereon so that each vibrator 35 is located at the midpoint of a brace 29. Vibrators of a type suited to the invention are commercially available from National Air Vibrator Company, 6830 Wynnwood Lane, Houston, Texas 77008, and are designated as Model No. BH-1. Vibrators 35 are bolted to braces 29 by nut and bolt arrangements 36 midway of the length of each brace and are thus aligned along a central longitudinal axis between the leading and trailing screed plates 20, 21. With this arrangement, it has been discovered that a substantially even distribution of vibration is imparted to both the leading screed plate 20 and trailing screed plate 21 as is evidenced by the substantially even pattern of vibration distribution which is generated and applied to the concrete as schematically illustrated in FIG. 5.

Air is supplied to vibrators 35 through flexible supply lines 37 having fittings 38 on the free ends thereof and adapted for snap-fit connection with the fittings 39 screwed into tube 22 and communicating with the tube bore 26 at appropriate locations. The number of fittings 39 mounted in tube bore 26 will, of course, be determined by the number of vibrators 35 which are employed.

Figure 3:
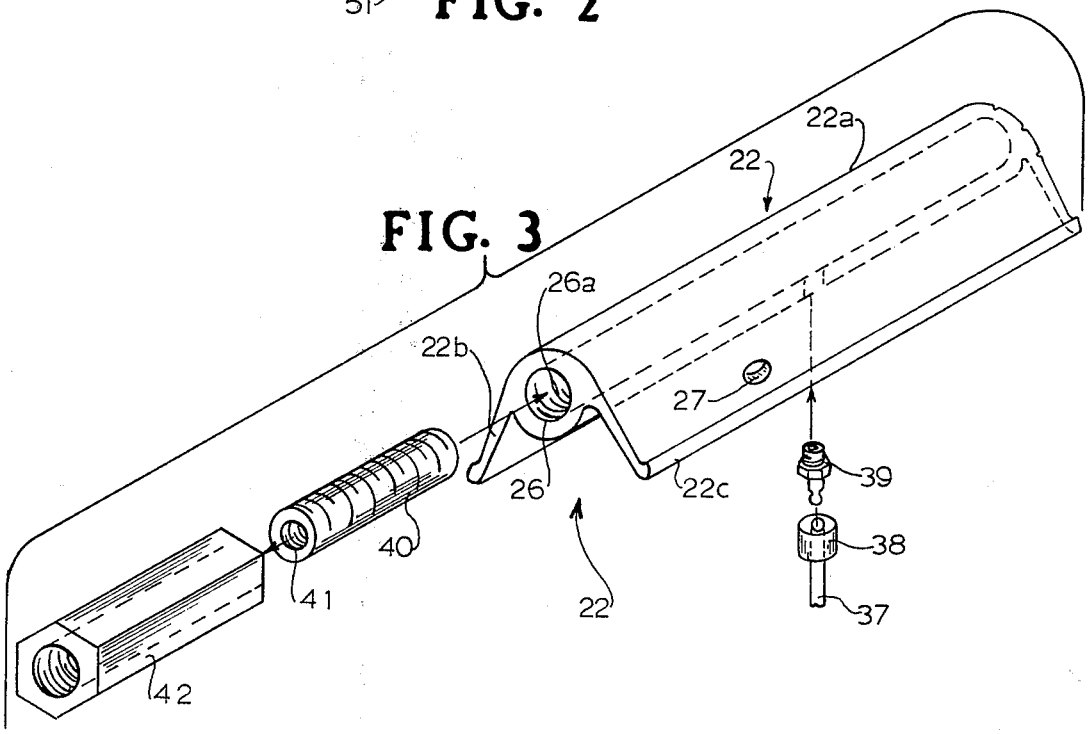
FIG. 3 is an enlarged perspective view of a section of a tubular frame member through which air is forced for operating the vibrators and winching units and with illustrated fittings for connecting the air vibrators and for connecting one such tubular member to another.
Figure 4:
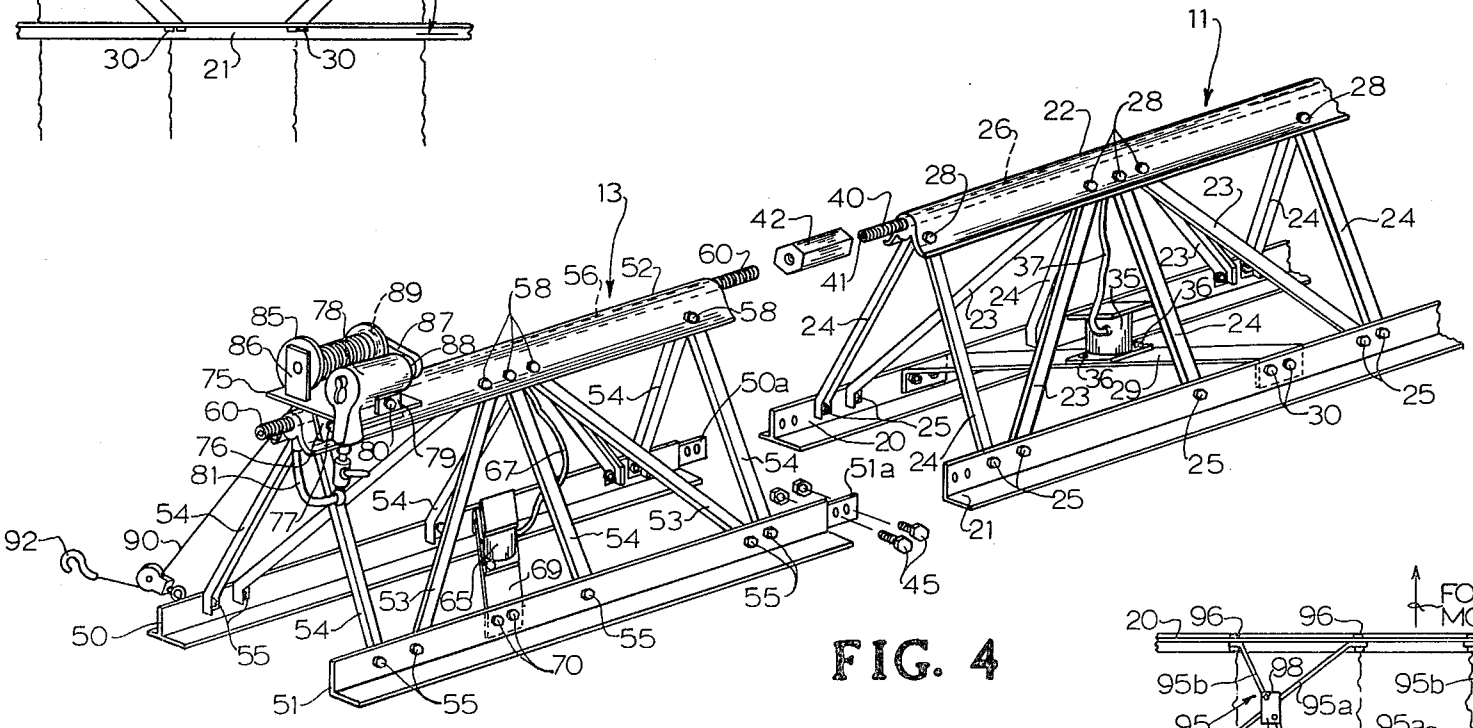
FIG. 4 is an enlarged fragmentary perspective view of one of the winching frame units and a portion of a base frame unit according to a first embodiment of the invention.

Provision is made for communicating the air supply between screed units by providing the outermost ends of each tube bore 26 with internal threads **26*a* adapted to receive an externally-threaded hollow stud member 40 as best illustrated in FIGS. 3 and 4. Stud member 40 has a bore 41 extending its length and receives on its free end an internally-threaded hollow turnbuckle 42 through which air is also adapted to pass. Air can thus be supplied to vibrators 35 on base frame unit 11 by passing through turnbuckle 42, stud member 40, tube bore 26, air fittings 39 and supply lines 37. The turnbuckles 42 at each end of the base frame unit 11 are in turn adapted to be connected to the winching frame units 12, 13** as next described.

Since the winching frame units 12, 13 are identical, a description of frame unit 13 will be given by way of example in reference to FIG. 4. Frame unit 13 includes a pair of screed plates 50, 51 which align with plates 20, 21 on base frame unit 11 and extensions **50*a*, 51*a* extend outwardly for connection to plates 20, 21 by means of bolt and nut arrangements 45 which tie the base portions of units 11 and 13 together. An extruded hollow ridge tube 52 on frame unit 13 corresponds to ridge tube 22 on base frame 11 and aligned therewith a pair of externally threaded hollow stud members 60, 60′ are threadably received at the opposite ends of tube bore 56 in ridge tube 52. The stud member 60 nearest turnbuckle 42 threadably receives turnbuckle 42 and is oppositely threaded from stud member 40. Thus, turnbuckle 42 can serve both as a means of communicating stud member 40 with stud member 60 and can also serve as a means for pivoting frame unit 13 with respect to frame unit 11 by tightening or loosening turnbuckle 42 to accommodate for level screeding or forming of a crown or valley effect. Of course, two or more frame units like base frame unit 11 can be interconnected in the same manner and the same level, valley or crown type of screeding can be effected over relatively wide spans by adjusting turnbuckles 42 and bolts 45**.

Figure 2:
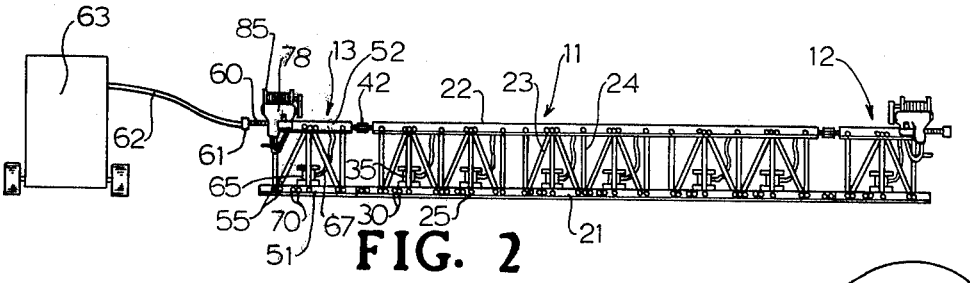
FIG. 2 is an enlarged rear elevation view of the screed apparatus of FIG. 1.

To continue the description concerned with distributing the air, it will be noted that the stud member 60′ on the outer end of winching frame unit 13 receives a fitting 61 for connecting supply line 62 to air source 63 as best seen in FIG. 2. The same general construction previously described in reference to base frame unit 11 is employed in winching frame unit 13. Thus, it will be noted that cross braces 53 and vertical braces 54 correspond to braces 23, 24 and connect plates 50, 51 to ridge tube 52 through nut and bolt arrangements 55, 58. A vibrator 65, corresponding to previously-mentioned vibrators 35, is mounted on an angularly disposed transverse brace 69 which is bolted to plates 50, 51 by other nut and bolt arrangements 70. Supply lines 67 from vibrator 65 connects to an air-fitting 68 (not shown) which is threadably received by ridge tube 52 and communicates with tube bore 56.

With continued reference to winching frame unit 13, it will be noted that support for an air-operated winching mechanism is provided by a platform plate 75 which is rigidly secured by welding to brackets 76. Brackets 76 are in turn secured to flanges 52*a*, 52*b* of unit 13 by bolt and nut arrangements which allow the winching unit to be located along the length of the screed wherever desired. In FIG. 4, platform 75 is shown secured to ridge tube 52 at its outermost end adjacent the air passage provided by the hollow stud member 60'. A reversible variable speed air motor 78, such as employed in an impact wrench, is rigidly secured to platform 75 by brackets 79 and bolts 80. Air is supplied to air motor 78 through line 81 which connects to a fitting 82 threaded into bore 56 of tube 52.

A winching drum 85 is rotatably mounted on brackets 86 which are welded to platform 75. Drum 85 is driven by air motor 78 through chain 87 and sprockets 88, 89. A winching cable 90 is coiled on drum 85 and extends from drum 85 around pulley 91 and forward to a suitable anchoring structure 93 utilizing hook 92.

While the foregoing description has dealt primarily with describing the winching unit 13, it will, of course, be understood that the construction employed in winching unit 12 is identical to that employed in winching unit 13. Also, where a pair of winching units, i.e., winching units 12, 13, are employed there will be a pair of connecting cables 90 and a pair of anchoring structures 93 as depicted in FIG. 1. Each winching unit may, of course, be bolted to the appropriate ridge tube at any desired location in the manner previously described with reference to brackets 76 and the bolt and nut arrangements 77. Also, it should be noted that in some applications a single winching unit might be employed where a relatively narrow working span is involved. Utilizing a reversible air motor of the type previously mentioned also allows the cable to be retracted once the job has been completed. Furthermore, the speed of winching can be readily controlled by use of an appropriate air valve such as valve 94 shown connected to the air motor supply line 81.

Figure 6:
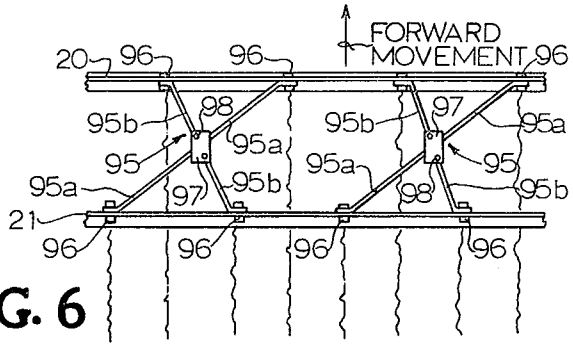
FIG. 6 is a schematic plan view illustrating an alternative brace arrangement for achieving the desired vibration pattern.

In operation, pressurized air will be supplied to ridge tube 52 from air source 63. Part of the air supplied will be diverted to air motor 78 for the winching operation and other pressurized air will be directed to vibrators 65 and 35 through the interconnected hollow ridge tubes 52 and 22. As the respective vibrators 65, 35 operate, the vibrations produced will be transmitted through the respective braces 69, 29 to the respective leading and trailing interconnected plates 50, 51 and 20, 21 so as to achieve the relatively uniform vibration pattern depicted in FIG. 5. Each vibrator will, of course, establish a point of vibration at both ends of the brace on which the particular vibrator is located, as best seen in FIG. 5. Thus, the number of vibrators required is reduced as compared to the number of vibrators that would be required if a vibrator were located at each point of vibration, i.e., at those points corresponding to the ends of braces 69 and 29. An alternative arrangement for mounting the vibrators 35, 64 is illustrated in FIG. 6 in which X-braces 95 replace braces 29, 69 and are integrally secured to blades 20, 21, 50, 51 by appropriate nut and bolt arrangements 96. Braces 95 are made up of long brace legs 95*a* and short brace legs 95*b*. Legs 95*a*, 95*b* are integrally secured by either bolts or welds to form a slanted-X configuration when viewed in plan as depicted in FIG. 6. A plate 97 is secured by welds or bolts at the center of the X-braces to provide a mounting for vibrators 35. Vibrators 35 are in turn removably mounted on plates 97 by bolts 35 which pass through holes 98 and with nuts (not shown) acting to secure vibrators 35 to plates 97. Thus, vibrators 35 may be easily removed for repair, replacement or cleaning. In the FIG. 6 configuration, it will be seen that each vibrator 35 establishes four points of vibration corresponding to the ends of the X-braces at which the nut and bolt arrangements 96 are located. Thus, for some concrete operations, a more concentrated vibration pattern can be achieved using the same number of vibrators as the first embodiment described.

What is claimed is:

1. A vibrating concrete screed comprising:

(a) an elongate open structure frame in the form of an isosceles triangle in cross section including:

(i) a pair of parallel spaced apart screed plates positioned at the lower corners of said triangle and adapted to engage and level concrete as said screed is moved over the concrete;

(ii) a hollow structurally strengthening ridge tube positioned at the apex of said triangle and extending with its bore for the length of said frame;

(iii) side braces fixed to and extending between said screed plates and said ridge tube;

(iv) angled base braces extending between said screed plates and fixed thereto at respective non-opposed points of securement;

(b) a set of air-operated vibrators spaced along the length of said frame and each being centrally located on a said angled brace;

(c) conduit means communicating each said vibrator to a selected location in the bore of said tube; and (d) a pressurized air source communicating with said ridge tube bore for energizing said vibrators whereby to establish points of vibrations in said screed plates at each said point of securement of said angled braces thereto.

2. A screed as claimed in claim 1 wherein the central axis of each said angled cross brace forms an included angle of between 15° to 45° with the longitudinal axis of said plates.

3. A screed as claimed in claim 1 wherein each said angled base brace is formed in an X-pattern, is secured at four non-opposed points of securement to said plates and each mounts and said air vibrator centrally of said X-pattern whereby to establish two points of vibration on one plate which are non-opposed to two points of vibration established on the other plate.

4. A screed as claimed in claim 1 including an air-operated winching means secured to said screed and dependent for an air supply on conduit means communicating with the bore of said ridge tube whereby said air source is enabled to simultaneously communicate pressurized air through said ridge tube to said vibrators to achieve vibration of said frame and to said winching means to achieve winching of said frame.

5. A screed as claimed in claim 1 wherein said ridge tube is formed with downwardly and outwardly extending flange portions and the upper ends of said side braces are adapted to be overlapped by and bolted to said flange portions to strengthen and secure said frame together.

6. A vibrating concrete screed comprising:

(a) an elongate open structure frame including:

(i) a pair of parallel spaced apart screed plates positioned at lower base corners of said frame and adapted to engage and level concrete as said screed is moved over the concrete;

(ii) a hollow tube member extending with its bore for the length of said frame;

(iii) side braces fixed to and extending between said screed plates and the upper structure of said frame;

(iv) angled base braces extending between said screed plates and fixed thereto at respective non-opposed points of securement;

(b) a set of air-operated vibrators spaced along the length of said frame and each being located on a said angled brace at a position intermediate the length thereof;

(c) conduit means communicating each said vibrator to a selected location in the bore of said tube member; and (d) a pressurized air source communicating with said tube member bore for energizing said vibrators whereby to establish points of vibrations in said screed plates at each said point of securement of said angled braces thereto.

7. A vibrating concrete screed as claimed in claim 6:

(a) wherein said elongated frame is in the form of an isosceles triangle in cross section;

(b) wherein said screed plates are positioned at the lower corners of said triangle; and (c) said tube member comprises a structural tube member at the apex and extending for the length of said frame.

8. A screed as claimed in claim 6 including an air-operated winching means secured to said screed and dependent for an air supply on conduit means communicating with the bore of said tube member whereby said air source is enabled to simultaneously communicate pressurized air through said tube member to said vibrators to achieve vibration of said frame and to said winching means to achieve winching of said frame.

9. A vibrating concrete screed as claimed in claim 6:

(a) wherein said elongate open frame structure comprises at least a pair of separable frame units each having its own said screed plates, tube member, side and angled braces, vibrators and conduit means;

(b) including means removably connecting together adjacent end portions of adjacent frame units in fixed relationship to each other; and (c) including means interconnecting and communicating the respective said tube members and their respective bores to said air source such that said points of vibration are established at each said point of securement of said angled braces in all said units.

10. A vibrating concrete screed as claimed in claim 9 wherein said means interconnecting and communicating said respective tube members for each said pair of separable frame units includes adjustment means for varying the angular relationship of each frame unit relative to each other frame unit to which it is connected while maintaining air communication through the respective said tube members.

11. A screed as claimed in claim 7 wherein said elongate open frame structure comprises at least a pair of said separable frame units on either end of a base said frame unit and wherein each said frame unit at the end of said base unit includes an air-operated winching means secured to the respective said frame unit and dependent for an air supply on conduit means communicating with the bore of the tube member of the respective said frame unit on which said winching means is secured whereby said air source is enabled to simultaneously communicate pressurized air through said tube member to said vibrators to achieve vibration of said frame and to each said winching means to achieve winching of said frame at the outer extreme ends thereof.

* * * * *

UNITED STATES PATENT AND TRADEMARK OFFICE

CERTIFICATE OF CORRECTION

PATENT NO. : 4,261,694

DATED : April 14, 1981

INVENTOR(S) : Donald R. Morrison

It is certified that error appears in the above—identified patent and that said Letters Patent is hereby corrected as shown below:

Col. 6, line 53, second occurrence of "and" should be --a--.

Col. 8, line 26, "claim 7" should be --claim 9--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*